US006422287B1

(12) United States Patent
Wilke

(10) Patent No.: US 6,422,287 B1
(45) Date of Patent: Jul. 23, 2002

(54) SLIDE/SWING PATIO DOOR

(76) Inventor: James Bradley Wilke, S76 W12620 McShane Dr., Muskego, WI (US) 53150

( * ) Notice: Subject to any disclaimer, the term of this patent is extended or adjusted under 35 U.S.C. 154(b) by 0 days.

(21) Appl. No.: 09/613,532

(22) Filed: Jul. 10, 2000

(51) Int. Cl.[7] ..... A47H 1/00

(52) U.S. Cl. ..... 160/92; 160/195; 49/147; 49/164; 49/168

(58) Field of Search ..... 49/163, 164, 166, 49/168, 153, 154, 155, 156, 158, 61, 63, 67, 125, 127, 128, 130, 147, 148, 323, 449, 394; 52/207, 243.1; 160/90, 92

(56) References Cited

U.S. PATENT DOCUMENTS 4,305,227 A * 12/1981 Georgelin ..... 49/141
4,633,616 A 1/1987 Giguere ..... 49/425
5,031,271 A * 7/1991 Baus ..... 16/90
5,105,868 A * 4/1992 Riise ..... 160/90
5,598,665 A * 2/1997 Guddas ..... 49/449 X
5,970,660 A 10/1999 Jacobs ..... 49/425
6,029,411 A 2/2000 Richardson ..... 52/204.51
6,061,961 A * 5/2000 Rupe ..... 49/168 X

* cited by examiner

*Primary Examiner*—Jerry Redman

(57) ABSTRACT

An apparatus and method for a slide/swing patio door including a frame having a first panel pivotally mounted on the frame and a second panel slidingly mounted in the frame in a plane adjacent to the first panel. The second panel slides toward the first panel until they are substantially congruent, at which time the first and second panels can be selectively moved out of the frame around a pivot of the first panel. Another embodiment includes a latch to couple the first panel and the second panel together before the panels can be moved around the pivot. An additional embodiment provides a lock pin mounted on the first panel configured to engage a box staple mounted on the frame. In addition, another embodiment further includes a guide mounted on the first panel aligned to engage the second panel, wherein the second panel is guided alongside of the first panel and supported by the guide on the first panel during movement around the pivot.

8 Claims, 3 Drawing Sheets

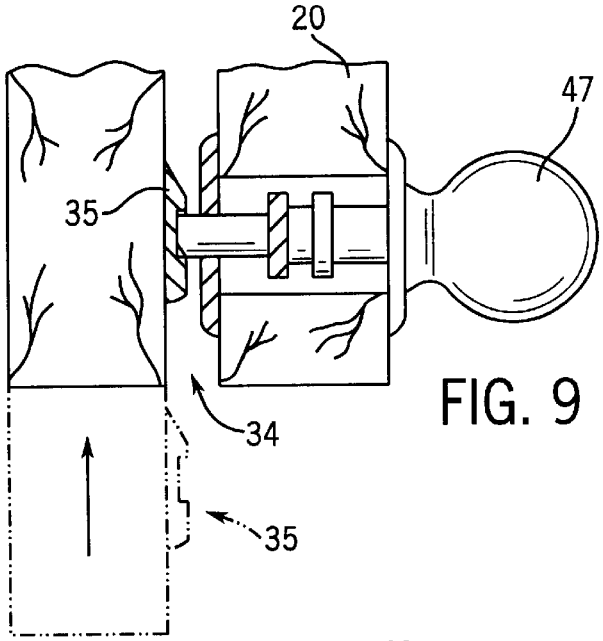
FIG. 9
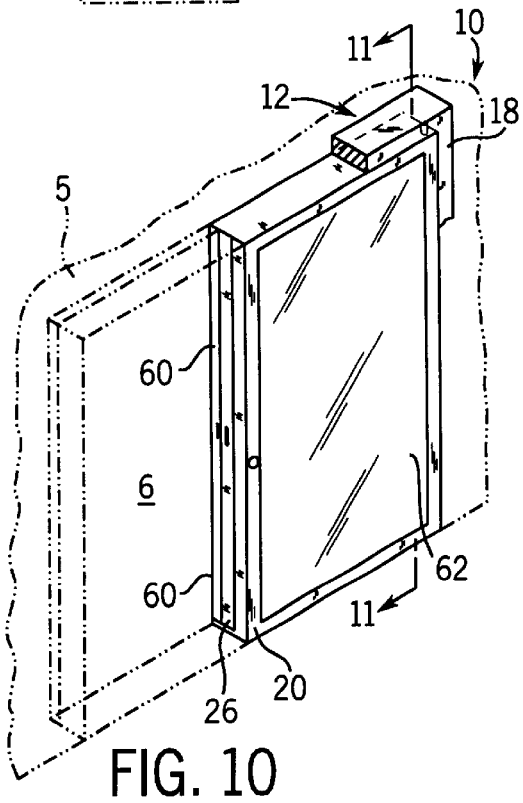
FIG. 10
FIG. 11
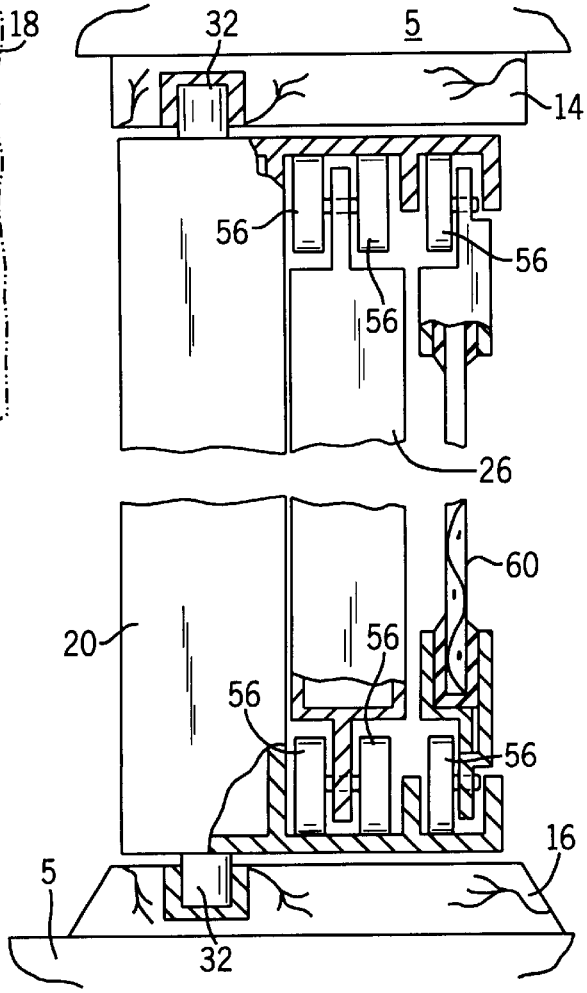

SLIDE/SWING PATIO DOOR

FIELD OF THE INVENTION

This disclosure relates generally to a door structure for a building opening, and more particularly to a slide/swing patio door with a sliding portion and a hinged portion.

BACKGROUND OF THE INVENTION

Building openings typically have door structures to allow ingress and egress to the building. In residential buildings one such door structure for an opening is adjacent to a balcony or patio and is typically referred to as a patio door. The usual arrangement for such door structures provides a fixed panel portion and a sliding panel portion. The panels typically include a single glass pane or a plurality of glass panes. It is known that even though the opening in the building spans the width of the two panels of the patio door, only one panel width is movable, I.e. the sliding panel portion. In another arrangement, the patio door is provided with two swinging panel portions. Each panel portion, or door, is hinged at the door frame and latched in the middle of the opening, typically to a post or column fixed in the middle of the building opening. In either case the open space for ingress or egress of a person, furniture, boxes, or the like is limited to a single panel portion width.

Thus, there is a need to provide a door structure that will allow access to the entire building opening. There is a further need to provide a patio door that does not obstruct ingress or egress through the full building opening. There is an additional need for a patio door that can slide and swing to a selected position and provide ingress and egress to a building.

SUMMARY OF THE INVENTION

One embodiment of the invention relates to a slide/swing patio door including a frame having a first panel pivotally mounted on the frame and a second panel slidingly mounted in the frame in a plane adjacent to the first panel. The first and second panels selectively move out of the frame around a pivot of the first panel. Another embodiment includes a latch to couple the first panel and the second panel together before the panels can be moved around the pivot. An additional embodiment provides a lock pin mounted on the first panel configured to engage a box staple mounted on the frame. In addition, another embodiment further includes a guide mounted on the first panel aligned to engage the second panel, wherein the second panel is guided along side the first panel and supported by the guide on the first panel during movement around the pivot.

There is also provided a method of opening and closing a patio door comprising a first panel and a second panel mounted in a frame, with the first panel pivotally mounted in the frame and second panel slidingly mounted in the frame, in a plane adjacent to the first panel. The method comprises the steps of sliding the second panel, toward the first panel until the two panels are substantially congruent. Then moving the first and second panel out of the frame around a pivot of the first panel a selected distance. Maintaining the first and second panel in the moved out position for a selected period time. Then moving the first and second panel back into the frame around the pivot of the first panel and sliding the second panel away from the first panel until the two panels are substantially incongruent.

BRIEF DESCRIPTION OF THE DRAWINGS

FIG. 9 is a partial side view of an example of a latch and latch plate engaging the first and second panel of a slide/swing patio door.

FIG. 10 is a perspective view of an exemplary embodiment of a slide/swing patio door including a screen panel slidingly mounted with the first and second panel of the door.

FIG. 11 is a partial sectional view of the slide/swing patio door illustrated in FIG. 10 along the line 11—11.

DETAILED DESCRIPTION OF THE EXEMPLARY EMBODIMENTS

Buildings, especially dwellings such as residential homes and apartments, are provided with openings for purposes of ingress and egress into and from the building. The openings typically are doors and especially are patio doors which can open onto a patio or balcony. The patios typically are composed of concrete or brick type elements or it can be a deck constructed typically of wooden members. The balconies are typically constructed of wooden members. The typical patio door has one fixed panel and one sliding panel, with the sliding panel providing the opening for the ingress and egress to the building. Typically, the panels are of the same size and configuration with the opening limited to the dimensions of the sliding panel. However, the opening in the building itself to accommodate the frame and patio door assembly is typically twice the width of the sliding panel. As a result, only half of the width of the opening in the building is available for ingress and egress to the building which is an inefficient and expensive utilization of building materials and space.

Figure 1:
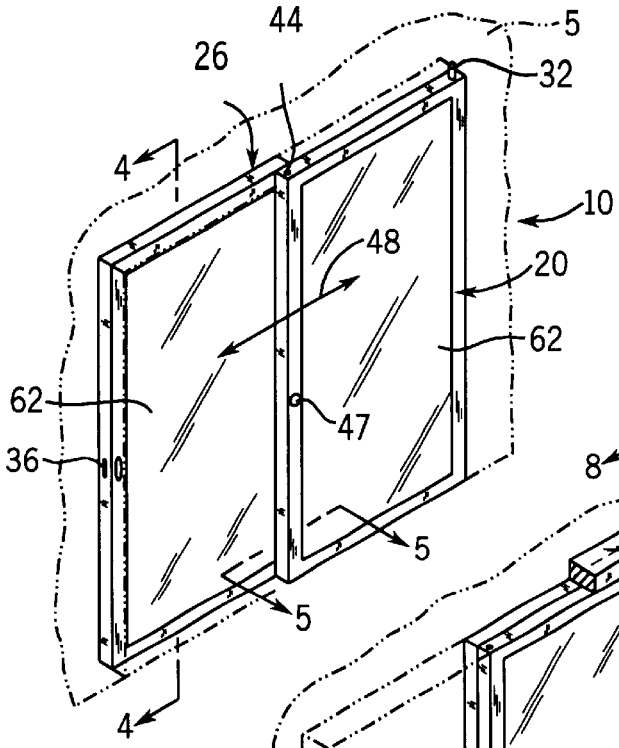
FIG. 1 is a perspective view of an exemplary embodiment of a slide/swing patio door having a first and second panel.
Figure 2:
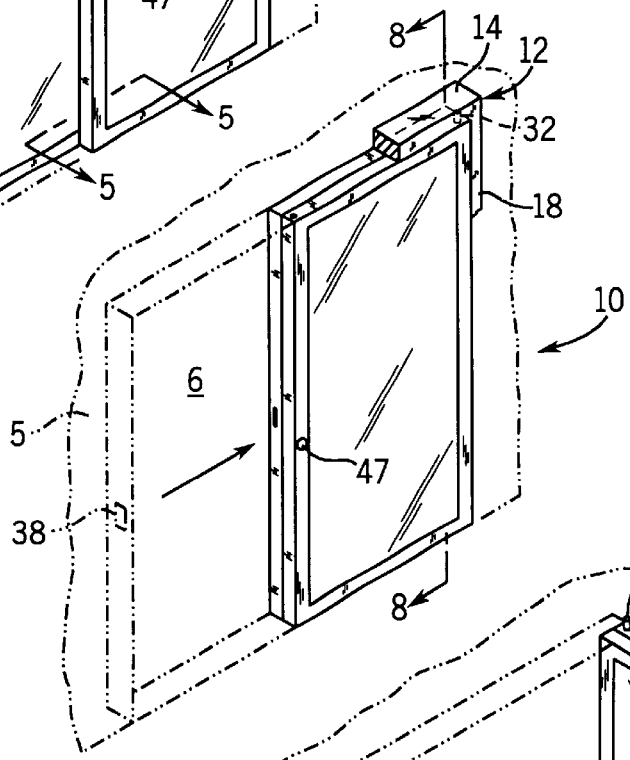
FIG. 2 is a perspective view of the slide/swing patio door illustrated in FIG. 1 with the second panel slidingly moved adjacent the first panel.
Figure 3:
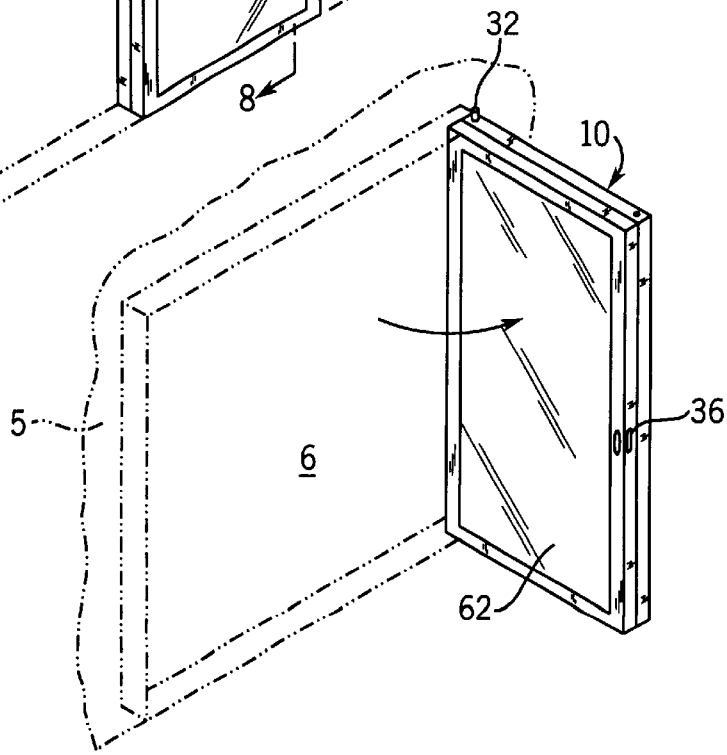
FIG. 3 is a perspective view of the slide/swing patio door illustrated in FIG. 2 with the first and second panels moved around a pivot of the first panel.
Figure 6:
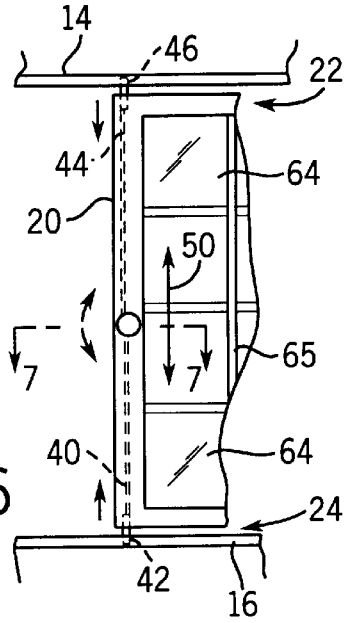
FIG. 6 is a partial side view of an embodiment of a slide/swing patio door illustrating a lock pin in the first panel engaging a box staple mounted in the top portion and bottom portion of the door frame.
Figure 5:
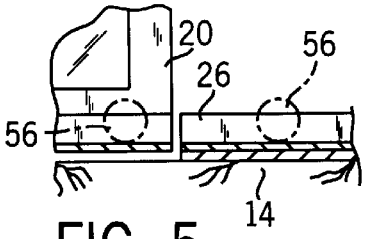
FIG. 5 is a partial sectional view of the slide/swing patio door illustrated in FIG. 1, at the line 5—5.
Figure 4:
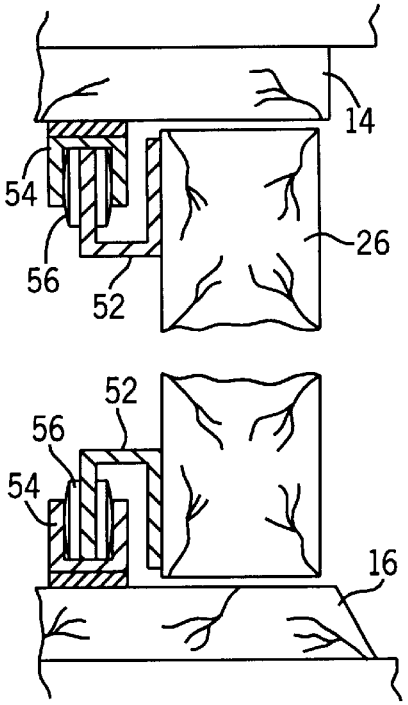
FIG. 4 is a partial sectional side view of the slide/swing patio door illustrated in FIG. 1, at the line 4—4.

Referring to the figures, and especially FIGS. 1–3, there is provided a slide/swing patio door 10 installed in an opening 6 of a building 5. The slide/swing patio door 10 comprises a frame 12 installed in the building 5 opening 6. The frame can be of any convenient and conventional construction, such as a wood or metal framing. The frame can also be molded or constructed from an engineered material such as a composite material. The frame 12 typically has a top portion 14, a bottom portion 16 and two side portions 18 forming a polygon which is installed in the opening 6 of the building 5. A first panel 20 is pivotally mounted in the frame 12. A second panel 26 is slidingly mounted in the frame 12 in a plane 48 adjacent to the first panel 20 wherein the first and second panels 20, 26 selectively move out of the frame 12 around a pivot 32 of the first panel. See FIG. 3. The first panel 20 is provided with a top portion 22 and a bottom portion 24 as well as the second panel 26 being provided with a top portion 28 and a bottom portion 30. The pivot 32 can be a rod mounted in the first panel 20 and configured to engage an orifice in the frame 12. The pivot 32 can also be two rods, with one rod in the top portion 22 and a second rod in the bottom portion 24 of the first panel 20. It should be understood that the pivot 32 can be mounted in the frame 12 and engage an orifice in the first panel 20 in accord with the scope of this disclosure. The first panel 20 and the second panel 26 can be constructed from a solid glass pane 62 which can be a single pane of glass, multiple panes of glass or a thermal pane construction. The first panel 20 can also be constructed of multiple panes 64 (See FIG. 6) with each pane section mounted in a network of pane frames. The panel can also be provided with decorative lattice inserts 65 which can be mounted externally to the glass portion of the panel or can be sandwiched, internally, between several panes of glass. The second panel 26 of the slide/swing patio door 10 is constructed in a similar manner as described for the first panel above. The slide/swing patio door 10 can also include a latch 34 (See FIG. 9) to couple the first panel 20 and the second panel 26 together before the panels are moved around the pivot 32. Another aspect of the slide/swing patio door 10 includes a lock 36 mounted on the second panel 26 and configured to engage a lock plate 35 mounted on the frame 12. It should be understood that the lock 36 and lockplate 35 can be alternatively mounted on the opposite panels as described above.

The slide/swing patio door 10 can also include a lock pin 40 mounted in the first panel 20 configured to engage a box staple 42 mounted on the frame 12. A second lock pin 44 mounted on the first panel 20 opposite the other lock pin 40 and configured to engage a second box staple 46 is mounted in one of the top portion 14 and a bottom portion 16 of the frame. See FIGS. 7 and 8. The lock pins 40 and 44 secure the first panel 20 in its closed position but still allow the second panel 26 to slide from an open to a closed position. At such time as an operator of the slide/swing patio door 10 desires to utilize the entire opening 6 in the frame 12, the lock pin 40 and second lock pin 44 are disengaged from their respective box staples 42, 46 and the entire first and second panel 20, 26 are swung from the closed position to the open position about the pivot 32 in the first panel 20 as shown in FIG. 3. The typical arrangement is to have the lock 36 mounted in a horizontal plane 48 and the lock pins 40, 44 mounted in a vertical plane 50. It should be understood that the lock 36 and the lock pins 40, 44 can be provided with a combination or key or electronic digital locking mechanisms to secure the first panel 20 and the second panel 26 in the frame 12 and still be within the scope of this disclosure.

Another aspect of the patio slide/swing door 10 comprises a guide 52 mounted on the first panel 20 aligned and configured to engage the second panel 26 wherein the second panel 26 is guided alongside the first panel 20 and supported by the guide 52 on the first panel 20 during movement around the pivot 32. See FIGS. 2, 3 and 8. A second guide 54 can be mounted on the first panel 20 opposite from the other guide 52 and aligned and configured to engage one of a top portion 28 and a bottom portion 30 of the second panel 26. The guides can be of any convenient construction and configuration such as a C-cross section or a J-cross section that engage each other and can be constructed of convenient materials such as wood or metal. The guides can also be provided with a low friction cladding such as Teflon® or the like. Another aspect of the guides can be provided with a rotating member 56 rotably mounted on at least one of the guides. The rotary member 56 can be of a disk construction or a ball and socket construction with the socket mounted on one guide and the ball rotably engaging the other guide.

Another aspect of the slide/swing patio door 10 includes a screen panel 60 (see FIGS. 10 and 11) slidingly mounted in the frame 12, in a plane 48 adjacent to one of the first and second panels, 20, 26, wherein the screen panel 60 can selectively slide alongside one of the first 20 and second 26 panel and selectively moves out of the frame around the pivot 32 of the first panel 20 with the first and second panels 20 and 26. The screen panel 60 can be constructed from a metal or a plastic mesh and mounted in a frame having similar overall dimensions as the first and second panels 20, 26.

Figure 7:
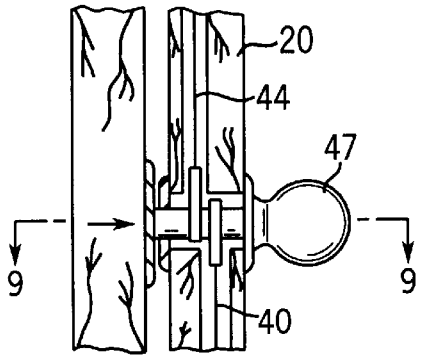
FIG. 7 is a partial sectional view of the slide/swing patio door illustrated in FIG. 6, at the line 7—7.
Figure 8:
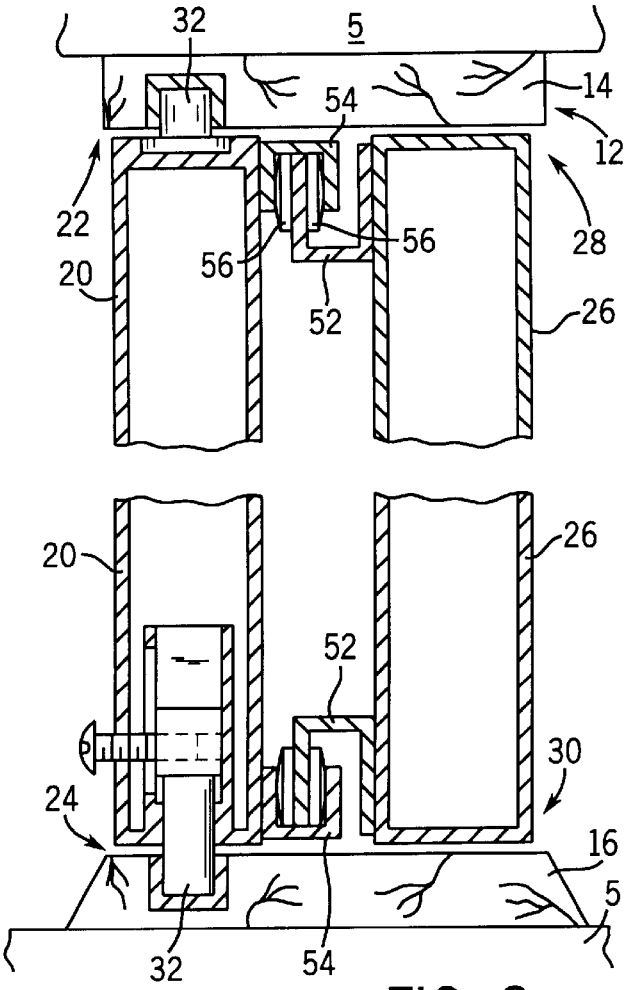
FIG. 8 is a partial sectional view of an exemplary embodiment of a slide/swing patio door illustrating an example of guides having rotating members.

Each of the panels, 20, 26 and screen panel 60 can be provided with a handle 47 to facilitate the opening and closing, by sliding or swinging, of the panels. A ball-type handle is illustrated in FIGS. 7 and 9, however, it should be understood that any convenient configuration for the handle can be utilized such as a lever or a recessed slide.

In operation, an operator would utilize the slide/swing patio door 10 for opening and closing the slide/swing patio door 10 with the steps of sliding the second panel 26 toward the first panel 20 until the two panels 20, 26 are substantially congruent as shown in FIG. 2. Then moving the first panel 20 and the second panel 26 out of the frame 12 around a pivot 32 of the first panel a selected distance as shown in FIG. 3. The operator would maintain the first 20 and second 26 panel in the moved out or open position for a selected period of time during which ingress and egress to the building 5 through the opening 6 can be utilized. When the operator has completed his operation of walking in and out of the building or moving materials in and out of the building, the slide/swing patio door 10 can be moved back into the frame 12 around the pivot 32 of the first panel 20 and sliding the second panel away from the first panel 20 until the two panels 20, 26 are substantially incongruent as shown in FIG. 1.

The method of utilization of the slide/swing patio door 10 can include steps of unlocking the second panel 26 from the frame 12 before moving the second panel 26 toward the first panel 20 utilizing the lock 36 mounted on the second panel 26, and disengaging the lock 36 from the lock plate 35 mounted in the frame 12. When the slide/swing patio door 10 is in its closed position, the operator can lock the second panel 26 to the frame 12 after moving the second panel 26 away from the first panel 20. After the second panel 26 is moved to the congruent position with the first panel 20, the operator can latch the two panels together before moving the panels out of the frame 12. When the operator again has closed the slide/swing patio door 10, the two panels 20, 26 can be unlatched after the panels are back into the frame 12 and the panels moved apart.

As is mentioned above, the first panel 20 may stay locked in the frame 12 with only half of the opening 6 in the building being utilized by the operator for a selected time or operation, however, the operator can also unlock the first panel 20 from the frame 12 before moving the first 20 and second 26 panel out of the frame 12, to utilize the entire opening 6. When the operator is done with the ingress and egress operation, the entire slide/swing patio door 10 assembly can be moved back into the frame 12 with the first panel 20 being locked to the frame 12.

A slide/swing patio door 10 for a building 5 can be provided with a means for framing the patio door as described above with a means for pivoting a first panel 20 in the means for framing and the means for sliding a second panel 26 in the means for framing in a plane adjacent to the first panel, wherein the first and second panels, 20, 26 selectively move out of the means for framing around the means for pivoting the first panel 20. The slide/swing patio door 10 can include a means for latching the first panel 20 and second panel 26 together before the panels can be moved around the means for pivoting. Another aspect of the slide/swing patio door 10 can include a means for locking one of the first and second panels, 20, 26 to the means for framing. The slide/swing patio door 10 can also comprise a means for guiding mounted on the second panel 26 and aligned and configured to engage the second panel 20 wherein the second panel is guided alongside the first panel and supported by the means for guiding during movement around the means for pivoting. In addition, a second means for guiding can be mounted on the first panel 20 opposite from the other means for guiding and aligned and configured to engage one of a top portion 28 and a bottom portion of the second panel 30. The means for guiding can also include a means for rotating aligned to engage the other means for guiding mounted on the panels.

While the embodiments described and illustrated in the figures are presently preferred, it should be understood that these exemplary embodiments are offered by way of example only. The invention is not intended to be limited to any particular embodiment, but it is intended to extend to various modifications, but nevertheless fall within the scope of the appended claims. For example, the panels can be provided with material other than glass such as an acrylic panel or an opaque material. It is contemplated that electronic lock and latch mechanisms can be utilized to lock and latch the panels. It is also contemplated that actuators such as electric or hydraulic mechanism can be utilized to slide and swing the various panels into and out of their open and closed positions including by way of a remote control, which can be computer activated. Other modifications will be evident to those with ordinary skill in the art.

I claim:

1. A slide/swing patio door comprising;

a frame;

a first panel pivotally mounted in the frame;

a second panel slidingly mounted in the frame, in a plane adjacent to the first panel, wherein the first and second panels selectively move out of the frame around a pivot of the first panel;

a latch to couple the first panel and the second panel together before the panels can be moved around the pivot; and, a screen panel slidingly mounted in the frame, in a plane adjacent to one of the first and second panels, wherein the screen panel selectively slides along side one of the first and second panel and selectively moves out of the frame around the pivot of first panel with the first and second panel.

2. The slide/swing patio door of claim 1, including a lock mounted on the second panel arranged to engage a lock plate mounted on the frame.

3. The slide/swing patio door of claim 2, including a lock pin mounted on the first panel configured to engage a box staple mounted on the frame.

4. The slide/swing patio door of claim 3, including a second lock pin mounted on the first panel opposite the other lock pin and configured to engage a second box staple mounted on one of a top portion and a bottom portion of the frame.

5. The slide/swing patio door of claim 4, wherein the lock is mounted in a horizontal plane and the lock pins are mounted in a vertical plane.

6. The slide/swing patio door of claim 1, further comprising a guide mounted on the first panel aligned to engage the second panel, wherein the second panel is guided along side the first panel and supported by the guide on the first panel during movement around the pivot.

7. The slide/swing patio door of claim 6, wherein a second guide is mounted on the first panel opposite from the other guide and aligned to engage one of a top portion and a bottom portion of the second panel.

8. The slide/swing patio door of claim 7, wherein at least one of the guides includes a rotating member.

* * * * *